US009683206B2

(12) United States Patent
Motsenbocker

(10) Patent No.: US 9,683,206 B2
(45) **Date of Patent: *Jun. 20, 2017**

(54) LOW-VOC WATER-BASED CLEANER FOR PEN, INK, MARKERS, PAINT

(75) Inventor: Gregg Motsenbocker, San Diego, CA (US)

(73) Assignee: STONER, INC., Quarryville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/614,723

(22) Filed: Sep. 13, 2012

(65) Prior Publication Data

US 2016/0230127 A1 Aug. 11, 2016

(51) Int. Cl.

| | |
|---|---|
| ***C11D 3/26*** | (2006.01) |
| ***C11D 3/50*** | (2006.01) |
| ***C11D 7/26*** | (2006.01) |
| ***C11D 7/32*** | (2006.01) |
| ***C11D 7/36*** | (2006.01) |
| ***C11D 7/50*** | (2006.01) |

(52) U.S. Cl.

CPC ..... *C11D 3/50* (2013.01); *C11D 7/265* (2013.01); *C11D 7/3245* (2013.01); *C11D 7/36* (2013.01); *C11D 7/5022* (2013.01)

(58) Field of Classification Search

CPC ..... C11D 3/042; C11D 3/1226; C11D 3/2068; C11D 3/2072; C11D 3/26; C11D 3/50

USPC ..... 510/101, 170, 174, 201, 342, 365, 437, 510/467, 505, 506, 525

See application file for complete search history.

(56) References Cited

U.S. PATENT DOCUMENTS 5,227,085 A * 7/1993 Motsenbocker ..... C11D 3/3947 510/174

OTHER PUBLICATIONS

Office Action issued in related U.S. Appl. No. 13/614,461, Jul. 12, 2016.

* cited by examiner

*Primary Examiner* — Brian P Mruk

(74) *Attorney, Agent, or Firm* — Foley & Lardner LLP

(57) ABSTRACT

A Low-VOC, water-based cleaner containing TKPP Aqueous 60%, EDTA Versene 100, Glycol Ether DPNP, or glycol ether EB and DB, or just glycol ether EB, Acetone, Acetic Acid, and fragrance. The VOC content of this composition is selectable to be 18.18%. 9.09%, or 0% (zero).

17 Claims, No Drawings

LOW-VOC WATER-BASED CLEANER FOR PEN, INK, MARKERS, PAINT

FIELD OF THE INVENTION

Cleaning compositions to remove from surfaces such as desks, dry erase boards, spray equipment, and furniture deposits and stains such as dry erase marker, nail polish, correction fluid, fountain & ball-point pen, latex paint and wood stain and restore them as closely as possible to a clean condition.

BACKGROUND OF THE INVENTION

Porous surfaces, such as those of carpets, clothing, tablecloths, napkins, automobile seats, athletic shoes, and certain metal and metal composites, to name only few, and hard surfaces such as concrete, stucco, metal signs, tile, wallpaper, vinyls, and wood floors, often receive deleterious deposits and stains. Such deposits vary widely in their identity, for example paints, dry erase markers, permanent marker, latex paint, and wood stain. The term "deposit" includes all of the foregoing, including stains caused by liquids and solids.

The above recitation exemplifies a broad range of materials which need to be cleaned of a broad range of deposits and stains. In response to this need, an equally wide range of cleaning compositions already exists in the market.

Generally speaking, commercial compositions are limited both in the range of their effectiveness, and also as to how efficient they really are for their intended purpose. If one intends to remove a wide range of kinds of deposits, he is likely to find a nearly-equal number of formulations to buy for the purpose. In addition, some of the stains and deposits are usually only partially removed, and with risk to the material being cleaned. On the consumer market today, for example, there is no known composition which will remove wine from a white tablecloth. This product will.

Furthermore, many existing compositions are objectionable from an environmental standpoint. This composition is water-based, and is environmentally acceptable. It has two low-Volatile Organic Compound (VOC) forms and a zero-VOC form.

It is an object of this invention to provide a water-based environmentally acceptable, biodegradable cleaning composition which can be used to remove a surprisingly wide range of types of deposits and stains. Any residue of these compositions which might remain on the surface, or in the substrate underlying it, will not adversely affect the user or the surface to which it was applied.

BRIEF DESCRIPTION OF THE INVENTION

A composition according to this invention which provides for a wide range of applications is water-based and comprises, in addition to water: TKPP; EDTA (Ethylene diamine tetro acetic acid) and/or phytic acid or a mixture of them; glycol ether DPNP or glycol ether EB and DB; acetone and acetic acid. In this specification, the term glycol EB means ethylene glycol n-butyl ether, and the term EDTA means ethylene diamine tetra acetic acid. By selecting the appropriate components, a range of VOC numbers can be achieved, at, for example, 18.18% VOC, 9.09% VOC, and zero VOC.

This formulation represents a paradigm shift away from traditional cleaners. All cleaners in the market today clean specified substrates, e.g. tile cleaner, bathroom cleaner, floor cleaner, carpet cleaner, pre-wash; this formulation attacks specific stain types, for ANY substrate. Cleaners in today's market are basically just soap and water. This VOC-compliant formulation works better than non-VOC-formulations in the market, remaining safe for the environment, safe for the individual, and safe for any surface.

DETAILED DESCRIPTION OF THE INVENTION

This product consists essentially of a member of each of the following groups of ingredients:

a. De-ionized water
b. TKPP Aqueous 60%
c. EDTA Versene 100
d. Glycol Ether DPNP, or glycol ether EB and DB, or just glycol ether EB
e. Acetone
f. Acetic Acid
g. fragrance The proportions of the member or members in each group in the ultimate product are determined by the VOC percentage targeted for the product.

This is a water-based product. Percentages specified herein are in weight percentage of the total composition. However, in mixing the formulations to make the product, it is best practice to dissolve certain of the ingredients in water before adding them into the total formulation. If all of the ingredients are added to the water at one time, occasionally a clear solution might not result. For this reason it is preferred practice to dissolve the TKPP in water before adding the other ingredients.

Similarly, EDTA versene 100 is best supplied not as a dry product, but in a diluted form, about 34% EDTA to about 66% water. This is readily available in industrial concentration.

The other ingredients are either already liquid or readily dissolved, so as to enter the solution or be miscible with it. No special procedure is necessary as to them.

CAS Numbers

| | |
|---|---|
| TKPP Aqueous 60% | 7320-34-5 |
| EDTA Versene 100 | 60-00-4 |
| Glycol ether EB and DPNP | 111-76-2 |
| Glycol ether DB | 112-34-5 |
| Acetone | 67-64-1 |
| Acetic acid | 64-19-17 |
| De-ionized water | 7732-18-5 |

In all the the formulations and guidelines given below, at least one substance from each group must be included.

18.18% VOC Formulation Percentages

| | | |
|---|---|---|
| a. | De-ionized water | 39.24 |
| b. | Baypure CX | 4.18 |
| c. | TKPP | 1.63 |
| d. | De-ionized water | 27.77 |
| e. | Glycol ether EB | 18.18 |
| f. | Acetone | 8.18 |
| g. | Acetic acid | 0.32 |
| g. | Fragrance | 0.50 |

9.09% VOC Formulation Percentages

| | | |
|---|---|---|
| a. | De-ionized water | 39.24 |
| b. | TKPP | 1.63 |
| c. | EDTA Versene 100 | 4.18 |
| d. | De-ionized water | 27.77 |
| e. | Glycol ether EB | 9.09 |
| | Glycol ether DB | 9.09 |
| f. | Acetone | 8.18 |

-continued

| | | |
|---|---|---|
| g. | Acetic acid | 0.32 |
| h. | Fragrance | 0.50 |

Zero VOC Formulation Percentages—A

| | | |
|---|---|---|
| a. | De-ionized water | 39.24 |
| b. | TKPP | 1.63 |
| c. | EDTA Versene 100 | 4.18 |
| d. | De-ionized water | 27.77 |
| d. | Glycol ether DPNP | 18.18 |
| e. | Acetone | 8.18 |
| f. | Acetic acid | 0.32 |
| g. | Fragrance | 0.50 |

Zero VOC Formulation Percentages—B

| | | |
|---|---|---|
| a. | De-ionized water | 39.24 |
| b. | TKPP | 1.63 |
| c. | EDTA Versene 100 | 4.18 |
| d. | De-ionized water | 27.77 |
| d. | Glycol ether DB | 18.18 |
| e. | Acetone | 8.18 |
| f. | Acetic acid | 0.32 |
| g. | Fragrance | 0.50 |

Zero VOC Formulation Percentages—C

| | | |
|---|---|---|
| a. | De-ionized water | 39.24 |
| b. | TKPP | 1.63 |
| c. | EDTA Versene 100 | 4.18 |
| d. | De-ionized water | 27.77 |
| d. | Glycol ether DPNP | 9.09 |
| | Glycol Ether DB | 9.09 |
| e. | Acetone | 8.18 |
| f. | Acetic acid | 0.32 |
| g. | Fragrance | 0.50 |

The preferred embodiment is the first zero VOC formulation, formula A. The other formulations allow flexibility of product during the decrease in acceptable levels of VOCs in household cleaning products.

The combination of components used herein appears to function synergistically, by mechanisms which are not fully understood at this time. What has become apparent is that the total composition functions to a degree of effectiveness much greater than already-known compositions useful for the intended purposes, and that elimination of any of the groups greatly reduces the effectiveness of the composition.

Formulations according to this invention are remarkably versatile and effective for a wide range of deposits and stains on a wide range of substrates. Any residues can readily be removed, so that a clean surface remains. Any surface or substrate can be laundered or rinsed off to remove any residue.

This invention is not to be limited by the embodiments described in the description, which are given by way of example and not limitation, but only in accordance with the scope of the appended claims.

I claim:

1. A water-based composition for removing stains from substrates, wherein the composition has a Volatile Organic Compound (VOC) level of 18.18% or less, and the composition consists essentially of:

(a) TKPP;

(b) ethylene diamine tetra acetic acid (EDTA) or phytic acid, or a mixture thereof;

(c) (i) Dipropylene glycol n-propyl ether, or (ii) Diethylene glycol monobutyl ether, or (iii) a combination of Ethylene glycol monobutyl ether and Diethylene glycol monobutyl ether;

(d) acetone;

(e) acetic acid; and (f) water.

2. The composition of claim 1, further comprising a fragrance.

3. The composition of claim 1, wherein the VOC level is about 9.09% or less.

4. The composition of claim 1, wherein the VOC level is zero.

5. The composition of claim 1, wherein the EDTA is present in a diluted form, with about 34% EDTA to about 66% water.

6. The composition of claim 1, wherein the water is de-ionized.

7. A water-based composition for removing stains from substrates, wherein the composition has a Volatile Organic Compound (VOC) level of 18.18% or less, and the composition consists essentially of:

| | | |
|---|---|---|
| (a) | de-ionized water | 39.24%; |
| (b) | 34% solution of tetrasodium iminodisuccinate in water | 4.18%; |
| (c) | TKPP | 1.63%; |
| (d) | de-ionized water | 27.77%; |
| (e) | Ethylene glycol monobutyl ether | 18.18%; |
| (f) | Acetone | 8.18%; |
| (g) | Acetic acid | 0.32%; and |
| (h) | Fragrance | 0.50%. |

8. The composition of claim 1, having a VOC level of 9.09% and consisting essentially of:

| | | |
|---|---|---|
| (a) | de-ionized water | 39.24%; |
| (b) | TKPP | 1.63%; |
| (c) | about 34% EDTA in 66% water | 4.18%; |
| (d) | de-ionized water | 27.77%; |
| (e) | Ethylene glycol monbutyl ether | 9.09%; |
| (f) | Diethylene glycol monobutyl ether | 9.09%; |
| (g) | acetone | 8.18%; |
| (h) | acetic acid | 0.32%; and |
| (i) | fragrance | 0.50%. |

9. The composition of claim 1, having a VOC level of zero percent and consisting essentially of:

| | | |
|---|---|---|
| (a) | de-ionized water | 39.24%; |
| (b) | TKPP | 1.63%; |
| (c) | about 34% EDTA in 66% water | 4.18%; |
| (d) | de-ionized water | 27.77%; |
| (e) | Dipropylene glycol n-propyl ether | 18.18%; |
| (f) | acetone | 8.18%; |
| (g) | acetic acid | 0.32%; and |
| (h) | fragrance | 0.50%. |

10. The composition of claim 1, having a VOC level of zero percent and consisting essentially of:

| | | |
|---|---|---|
| (a) | de-ionized water | 39.24%; |
| (b) | TKPP | 1.63%; |
| (c) | about 34% EDTA in 66% water | 4.18%; |

-continued

| | | |
|---|---|---|
| (d) | de-ionized water | 27.77%; |
| (e) | Diethylene glycol monobutyl ether | 18.18%; |
| (f) | acetone | 8.18%; |
| (g) | acetic acid | 0.32%; and |
| (h) | fragrance | 0.50%. |

11. The composition of claim 1, having a VOC level of zero percent and consisting essentially of:

| | | |
|---|---|---|
| (a) | de-ionized water | 39.24%; |
| (b) | TKPP | 1.63%; |
| (c) | about 34% EDTA in 66% water | 4.18%; |
| (d) | de-ionized water | 27.77%; |
| (d) | Dipropylene glycol n-propyl ether | 9.09%; |
| (e) | Diethylene glycol monobutyl ether | 9.09%; |
| (f) | acetone | 8.18%; |
| (g) | acetic acid | 0.32%; and |
| (h) | fragrance | 0.50%. |

12. The composition of claim 1, wherein the composition removes stains from porous surfaces.

13. The composition of claim 12, wherein the porous surface is selected from the group consisting of carpets, clothing, tablecloths, napkins, automobile seats, athletic shoes, metal, and metal composites.

14. The composition of claim 1, wherein the composition removes stains from hard surfaces.

15. The composition of claim 14, wherein the hard surface is selected from the group consisting of desks, dry erase boards, spray equipment, furniture, concrete, stucco, metal signs, tile, wallpaper, vinyls, and wood floors.

16. The composition of claim 1, wherein the composition removes deposits and/or stains caused by a liquid or a solid.

17. The composition of claim 16, wherein the deposit or stain is caused by one or more of the following: wine, paint, latex paint, wood stain, dry erase marker, nail polish, correction fluid, fountain pen, ball-point pen, or permanent marker.

* * * * *